US008418941B2

(12) United States Patent
Melzer et al.

(10) Patent No.: US 8,418,941 B2
(45) Date of Patent: Apr. 16, 2013

(54) INJECTOR FOR A FUEL INJECTION SYSTEM

(75) Inventors: Markus Melzer, Schorndorf (DE); Joachim Boltz, Schwieberdingen (DE)

(73) Assignee: Robert Bosch GmbH, Stuttgart (DE)

( * ) Notice: Subject to any disclaimer, the term of this patent is extended or adjusted under 35 U.S.C. 154(b) by 768 days.

(21) Appl. No.: 12/600,771

(22) PCT Filed: May 6, 2008

(86) PCT No.: PCT/EP2008/055522

§ 371 (c)(1),
(2), (4) Date: Nov. 18, 2009

(87) PCT Pub. No.: WO2008/141918

PCT Pub. Date: Nov. 27, 2008

(65) Prior Publication Data

US 2010/0181392 A1 Jul. 22, 2010

(30) Foreign Application Priority Data

May 18, 2007 (DE) ..... 10 2007 023 384

(51) Int. Cl.

| | |
|---|---|
| ***F02M 47/02*** | (2006.01) |
| ***F02M 61/20*** | (2006.01) |
| ***F02M 39/00*** | (2006.01) |
| ***B05B 1/30*** | (2006.01) |

(52) U.S. Cl.

USPC .... 239/533.9; 239/88; 239/533.1; 239/533.2; 239/533.3; 239/584

(58) Field of Classification Search ..... 239/88, 239/533.1, 533.2, 533.3, 533.9, 584

See application file for complete search history.

(56) References Cited

U.S. PATENT DOCUMENTS

| | | | | |
|---|---|---|---|---|
| 3,387,790 | A * | 6/1968 | De Luca | 239/453 |
| 4,367,846 | A * | 1/1983 | Akagi | 239/96 |
| 4,509,691 | A * | 4/1985 | Skinner | 239/533.9 |
| 4,627,571 | A * | 12/1986 | Kato et al. | 239/90 |
| 5,713,520 | A * | 2/1998 | Glassey et al. | 239/92 |
| 2006/0043209 | A1 * | 3/2006 | Magel | 239/88 |

FOREIGN PATENT DOCUMENTS

| | | | |
|---|---|---|---|
| EP | 1416152 | A1 | 5/2004 |
| WO | 2004036027 | A1 | 4/2004 |

* cited by examiner

*Primary Examiner* — Ryan Reis

(74) *Attorney, Agent, or Firm* — Michael Best & Friedrich LLP

(57) ABSTRACT

The invention relates to an injector for a fuel injection system of an internal combustion engine, particularly in a motor vehicle, with an injector body which has a pressure booster section and a needle section. At least one injection hole is provided in the needle section. A nozzle needle which has an adjustable stroke is disposed in the needle section for controlling an injection of fuel through the at least one injection hole. A pressure booster is provided for increasing a fuel injection pressure relative to a system pressure. For this purpose, the pressure booster has a double-diameter or stepped piston, a control rod, and a pressure booster bottom which together form the boundary of a coupling chamber. A coupling path extends into the control rod and connects the coupling chamber, over a valve device which is located outside or within the injector, to a high-pressure supply of fuel.

23 Claims, 4 Drawing Sheets

INJECTOR FOR A FUEL INJECTION SYSTEM

CROSS-REFERENCE TO RELATED APPLICATION

This application is a 35 USC 371 application of PCT/EP2008/055522 filed on May 6, 2008.

BACKGROUND OF THE INVENTION

1. Field of the Invention

The present invention relates to an injector for a fuel injection system of an internal combustion engine, in particular in a motor vehicle.

2. Description of the Prior Art

In order to be able to further reduce pollutant emissions of internal combustion engines, further development has been primarily focused on increasing the injection pressure. In this connection, a large fuel volume in the injector body is advantageously sought in order to be able to keep pressure pulsations in multiple injections to a minimum. A reduction in hydraulic pulsations also has a favorable effect with regard to wear on the nozzle seat. The increase in the injection pressure in known injectors is usually achieved through execution of a pressure boosting, which is used to act on the fuel with a pressure that is greater than the pressure of the system, i.e. is acted on with a multiple of the atmospheric pressure, and at this high pressure, is metered into the combustion chamber. A supply of fuel to the pressure booster in this case is usually carried out via a plurality of interconnected bores, but these weaken the injector body, thus negatively affecting its service life, and are also susceptible to leaks.

ADVANTAGES AND SUMMARY OF THE INVENTION

The injector according to the invention has the advantage over the prior art that no bores for a hydraulic connection of a pressure boosting arrangement have to be provided in the injector body, thus making it possible to prolong the service life of the injector according to the invention. As in a conventional design, the injector according to the invention has a pressure boosting section, also referred to as the actuator section, and a needle section, the latter of which accommodates a nozzle needle that is able to execute a stroke motion in order to control an injection of fuel through at least one injection orifice. The pressure booster used to increase the fuel injection pressure has a stepped piston, a control rod, and a pressure booster bottom that cooperate with one another to delimit a coupler chamber. In lieu of bores in the injector body, in the injector according to the invention, a coupling path extending in the control rod is provided, which connects the coupler chamber to a high-pressure fuel supply via a valve device situated outside the injector. The essential advantage therefore lies in the simple central connection of the fuel supply to the pressure booster. This makes it possible to implement a relatively high injection pressure with a simultaneously moderate system pressure. In particular, the injector according to the invention also has a significantly improved multiple injection capacity because of its large high-pressure injector volume and reduced pressure pulsations thanks to its lack of control lines. Furthermore, it is also possible to achieve a rapid switching or actuation of the nozzle needle. The fact that it is possible to eliminate complex bores inside the injector body, which negatively affect the service life of the injector and are leakage-prone, significantly prolongs the service life of the injector according the invention.

The end of the control rod oriented toward the nozzle needle suitably reaches into a cavity provided in the pressure booster bottom; this cavity is hydraulically connected via a connecting path to a needle control chamber that is in turn delimited by the nozzle needle, a nozzle needle sleeve encompassing the needle, and the pressure booster bottom. The connecting path passing axially through the pressure booster piston, which can be embodied in the form of a bore for example, is situated centrally in comparison to conventional bores situated in the injector body and is therefore significantly easier to manufacture and seal. In particular, this design makes it possible to eliminate a hydraulic line routing in an injector body wall or outside the injector, leading to the needle control chamber, which constitutes a structurally simple and well-engineered embodiment.

In an advantageous embodiment of the design according to the invention, the stepped piston is encompassed by a filling sleeve that is able to execute a stroke motion on it or by a stationary annular wall; the stepped piston, the pressure booster bottom, and the filling sleeve or stationary annular wall cooperate with one another to delimit a pressure booster chamber, commonly also referred to as an intensifier chamber. In the embodiment with a filling sleeve, which is supported so that it is able to execute a stroke motion on the stepped piston, it is also possible for a prestressing spring to be provided, one end of which rests against a stop on the injector body and the other end of which rests against the filling sleeve, prestressing the latter against the pressure booster bottom. The stepped piston, the pressure booster bottom, and the filling sleeve or annular wall, together with the prestressing spring provided in the case of the filling sleeve, form a boosting device for boosting the pressure prevailing in the coupler chamber to a significantly higher pressure required for the injection process in the pressure booster chamber. A boosting action is produced by the significant size differences between the coupler chamber and the pressure booster chamber. This makes it possible to achieve a high injection pressure with a simultaneously moderate system pressure, thus permitting reduction of the pollutant emissions of the internal combustion engine equipped with the injector according to the invention.

In another advantageous embodiment of the design according to the invention, the injector body is provided with a high-pressure chamber in which the control rod, the stepped piston, and the filling sleeve or annular wall are situated. The high-pressure chamber in this case is significantly larger in comparison to the coupler chamber, the pressure booster chamber, and the needle control chamber and has the greatest volume. A large-volumed high-pressure chamber has a positive effect on pressure pulsations in multiple injections, which can be kept to a minimum.

The high-pressure fuel supply is suitably connected directly to the high-pressure chamber via a hydraulic line and indirectly to the coupling path in the control rod via the valve device. In this case, both the direct supply to the high-pressure chamber and the indirect supply to the coupling path in the control rod via the valve device extend at least partially parallel to each other in an injector end plate so that a connection of the injector according to the invention to the high-pressure fuel supply is possible via only one side, namely the injector end plate. It is therefore unnecessary to provide an additional, structurally complex line routing, for example to the pressure booster chamber or needle control chamber.

Other important defining characteristics and advantages of the injector according to the invention ensue from the dependent claims, the drawings, and the associated description of the figures given in conjunction with the drawings.

BRIEF DESCRIPTION OF THE DRAWINGS

Exemplary embodiments of the injector according to the invention are shown in the drawings and will be explained in detail in the subsequent description.

DESCRIPTION OF THE PREFERRED EMBODIMENTS

Figure 1:
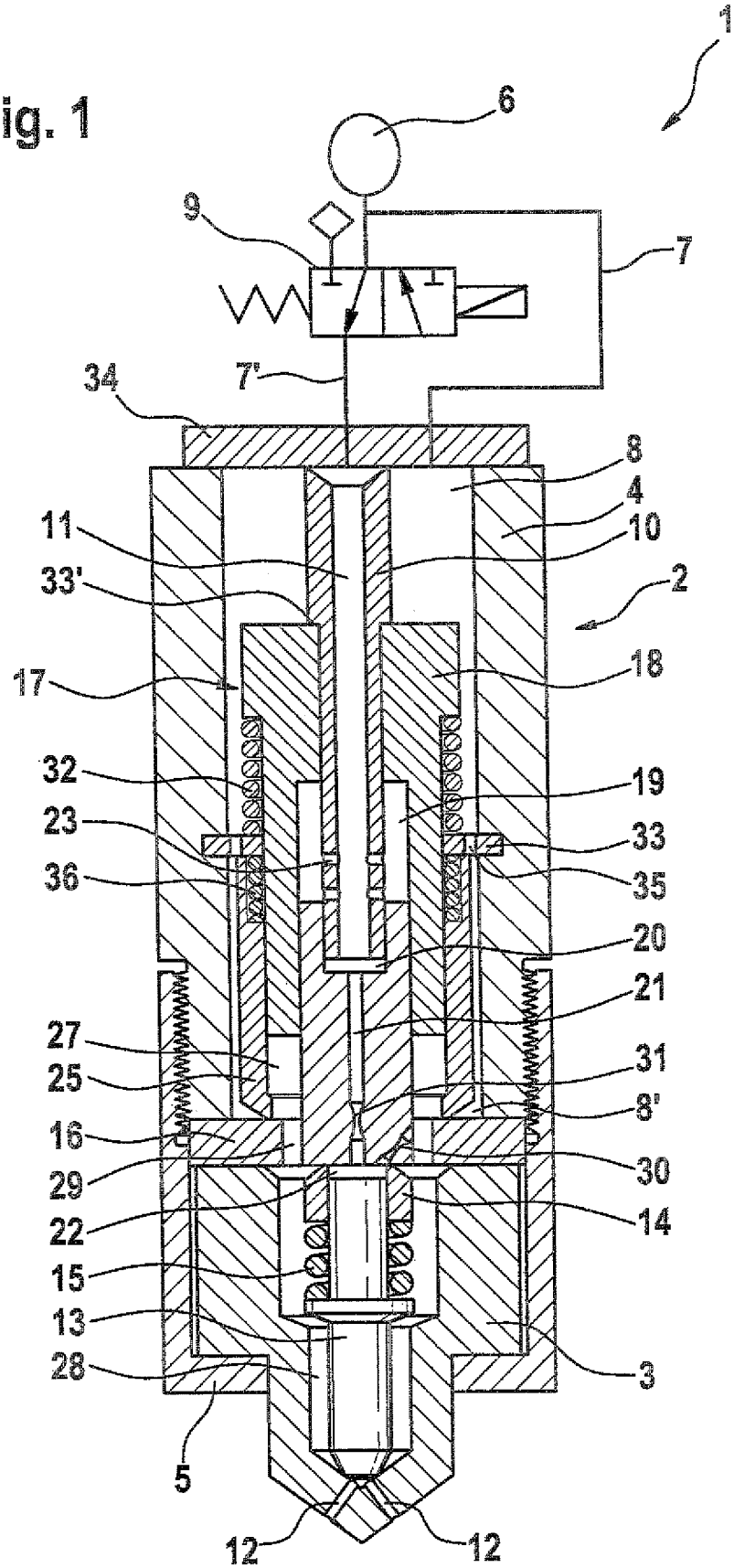
FIG. 1 is a very simplified schematic longitudinal section through an injector according to the invention.

According to FIGS. 1 through 4, the injector 1 according to the invention includes an injector body 2, which is usually composed of two sections, namely a needle section 3 situated at the bottom and a pressure booster section 4 situated above the former. The two sections 3 and 4 can be attached to each other by a suitable connecting technique, for example a welded connection or a screw connection. In the exemplary embodiments shown, a clamping nut 5 is provided, which encompasses the needle section 3 and clamps it against the pressure booster section 4. The clamping nut 5 is preferably screwed onto the pressure booster section 4.

The injector 1 is supplied by a high-pressure fuel supply 6, which is connected directly to a high-pressure chamber 8 situated in the injector 1 via a hydraulic line 7 and is connected indirectly to a coupling path 11 situated in a control rod 10 via a hydraulic line 7' equipped with a valve device 9.

The needle section 3 is provided with at least one injection orifice 12 and a nozzle needle 13 supported so that it is able to execute a stroke motion in order to control an injection of fuel through the at least one injection orifice 12. At an end oriented away from the at least one injection orifice 12, the nozzle needle 13 has a nozzle needle sleeve 14 encompassing it, which is prestressed against a pressure booster bottom 16 by a closing compression spring 15, one end of which rests against the nozzle needle sleeve 14 and the other end of which rests against the nozzle needle 13 or against a stop situated there. At the same time, the closing compression spring 15 prestresses the nozzle needle 13 into its closed position. The nozzle needle 13 is situated so that it is able to execute a stroke motion in a nozzle chamber 28, which is hydraulically connected to a pressure booster chamber 27 via at least one through opening 29 provided in the pressure booster bottom 16. The pressure booster section 4 contains a pressure booster 17 for increasing a fuel injection pressure in relation to a system pressure. The pressure booster 17 has a stepped piston 18, the control rod 10, and the pressure booster bottom 16, which cooperate with one another to delimit a coupler chamber 19. According to the invention, the coupling path 11 extends inside the control rod 10 and connects the coupler chamber 19 to the high-pressure fuel supply 6 via the valve device 9 situated outside the injector 1. The valve device 9 here can for example be embodied in the form of a solenoid valve or a piezoelectric actuator or also in the form of a 2/2-way or 3/2-way solenoid valve or piezoelectric valve that has a 3/2-way functionality in combination with a servo valve.

Figure 2:
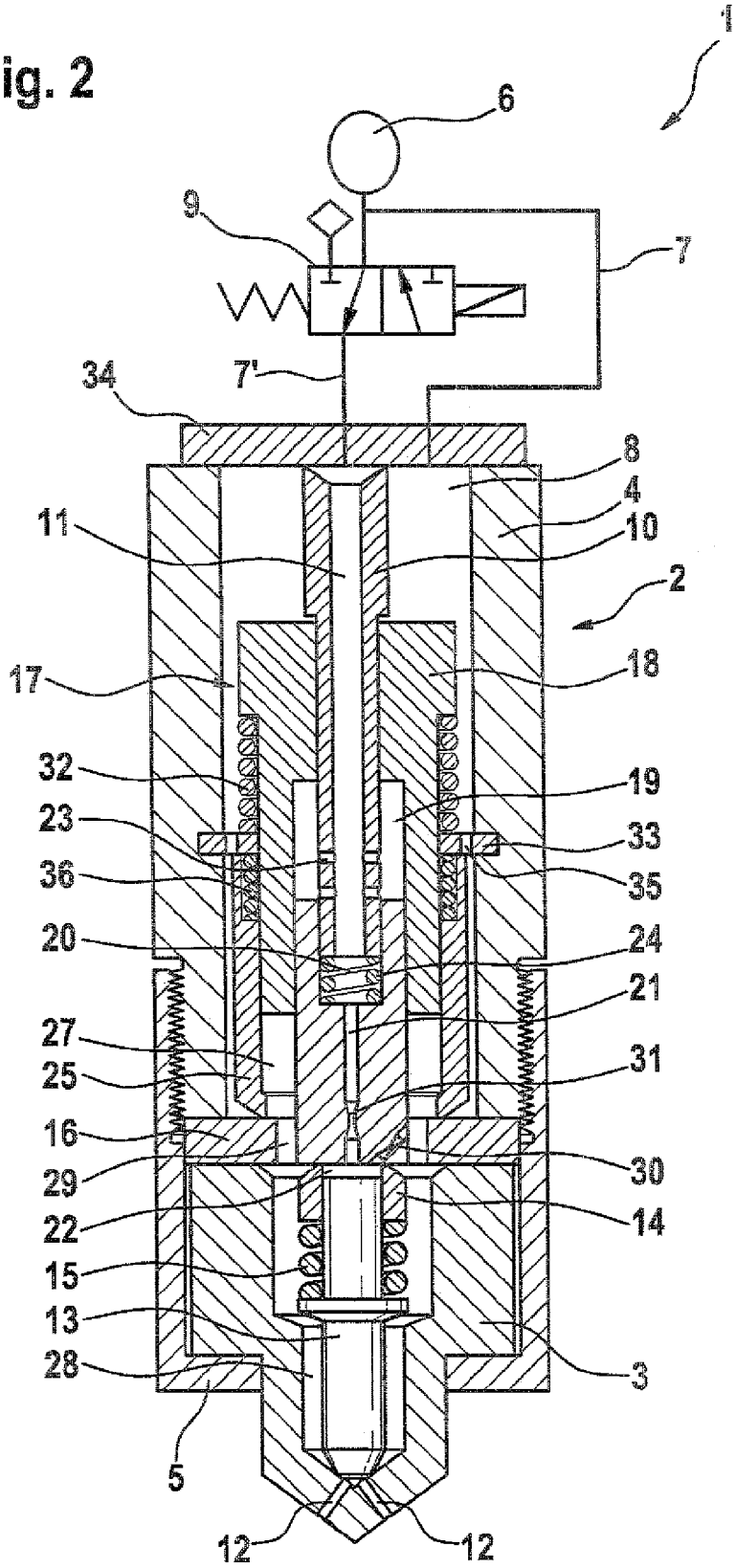
FIG. 2 is a schematic depiction like the one in FIG. 1, but of a different embodiment.
Figure 3:
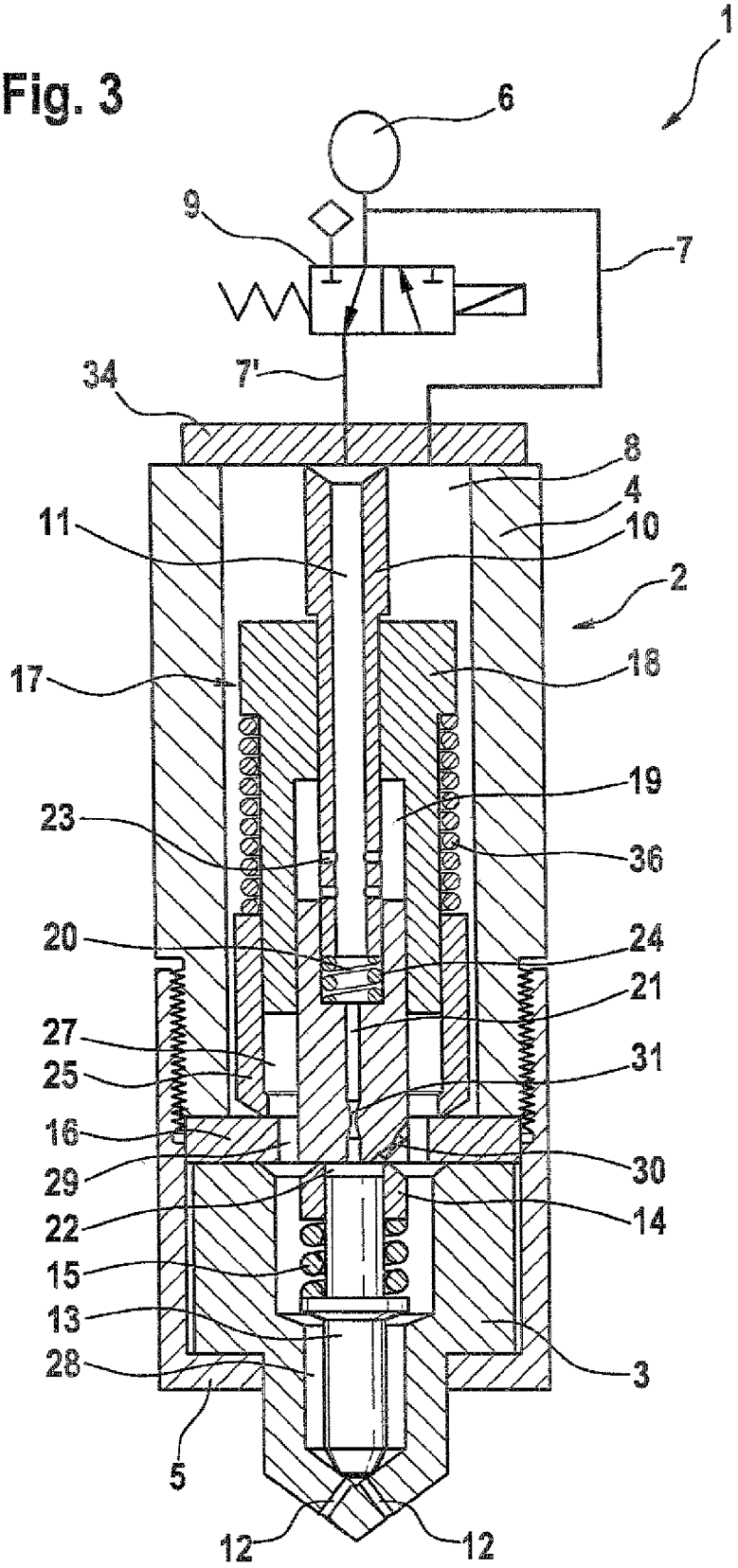
FIG. 3 is also a schematic depiction like the one in FIG. 1, but of a different embodiment.
Figure 4:
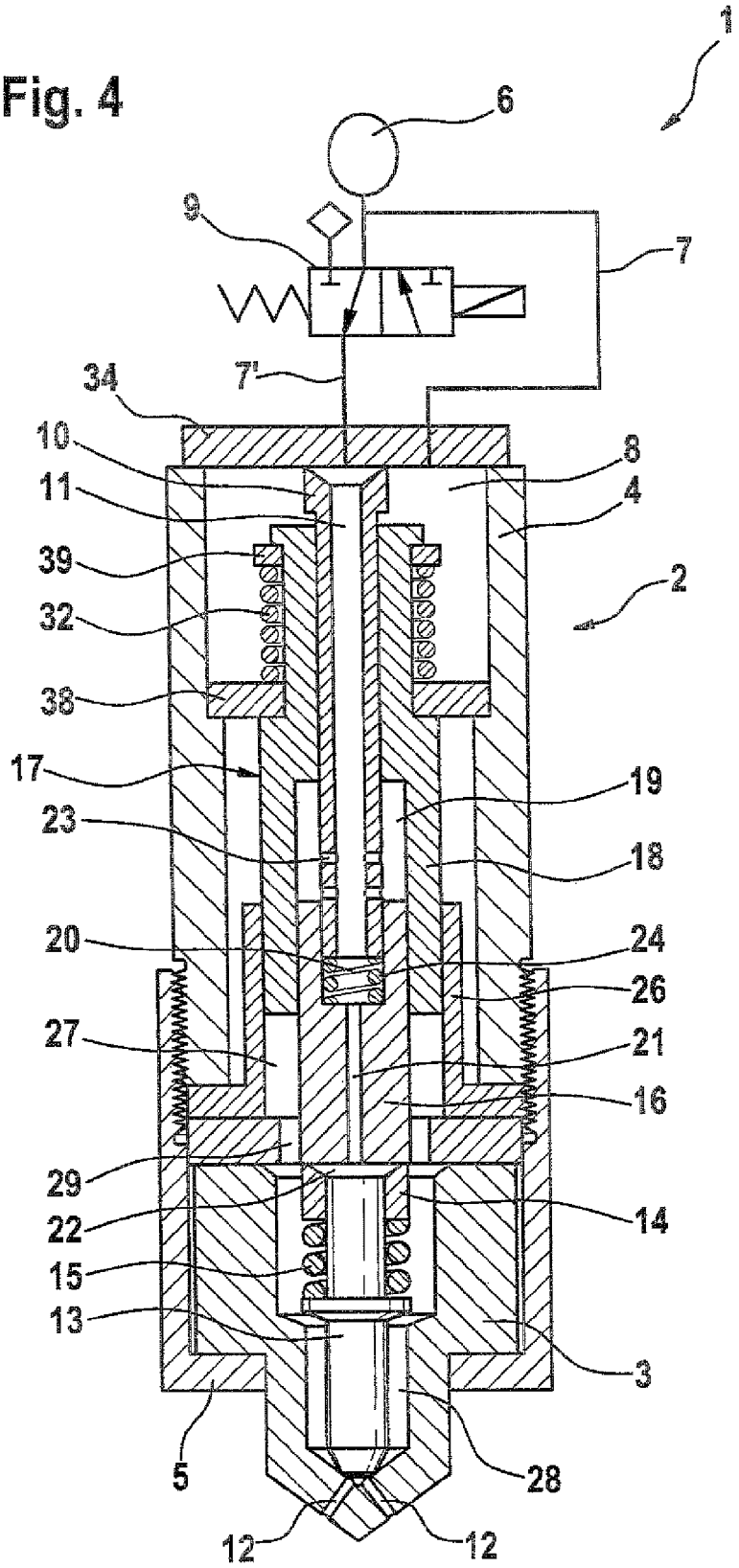
FIG. 4 is a very simplified schematic longitudinal section through another embodiment of the injector according to the invention.

With its end oriented toward the nozzle needle 13, the control rod 10 reaches into a cavity 20 provided in the pressure booster bottom 16, which cavity is hydraulically connected to a needle control chamber 22 via a connecting path 21. The needle control chamber 22 here is delimited by the nozzle needle 13, the nozzle needle sleeve 14 encompassing the latter, and the pressure booster bottom 16. At the same time, the cavity 20 is connected to the coupler chamber 19 via the coupling path 11; the coupling path 11 has radial openings 23 in the region of the coupler chamber 19. As is shown in FIGS. 2 through 4, it is possible for the cavity 20 to contain a control rod spring 24, which prestresses the control rod 10 in the direction oriented out from the cavity 20, i.e. upward. In the pressure booster bottom 16, a connecting line 30 is also provided, which is embodied for example in the form of a bore and hydraulically connects the pressure booster chamber 27 to the needle control chamber 22. The connecting line 30 and/or the connecting path 21 can optionally be provided with a throttle device 31; for example, the throttle device 31 in the connecting path 21 can be embodied in the form of an outlet throttle and the throttle device 31 in the connecting line 30 can be embodied in the form of an inlet throttle.

According to FIGS. 1 through 3, the stepped piston 18 of the pressure booster 17 is encompassed by a filling sleeve 25 that is supported so that it is able to execute a stroke motion on the stepped piston 18. According to FIG. 4, the stepped piston 18 is encompassed by a stationary annular wall 26. The annular wall 26 in this case can be embodied as separate from or of one piece with the pressure booster bottom 16. The stepped piston 18, the pressure booster bottom 16, and a filling sleeve 25 or stationary annular wall 26 cooperate with one another to delimit a pressure booster chamber 27.

According to FIGS. 1, 2, and 4, a stepped piston spring 32 is provided, one end of which rests against a stop 33 on the injector body or collar 38 (FIG. 4) and the other end of which rests against the stepped piston 18. According to FIGS. 1 and 2, the stepped piston spring 32 presses the stepped piston 18 upward, thus clamping it in a nonoperating state against a stop 33', which is embodied as an annular external step on the control rod 10. At the same time, this presses the control rod 10 against an end plate 34, thus sealing the coupling path 11 in relation to the high-pressure chamber 8.

The stop 33 on the injector body is provided with at least one axial through opening 35, which hydraulically connects the high-pressure chamber 8 to its section 8' (FIG. 1) situated below the stop 33.

According to FIGS. 1 and 2, a prestressing spring 36, which prestresses the filling sleeve 25 against the pressure booster bottom 16, rests against a side of the stop 33 oriented away from the stepped piston spring 32. In the embodiment according to FIG. 3, the prestressing spring 36 is embodied in the form of a clamping spring, one end of which rests against the stepped piston 18 and the other end of which rests against the filling sleeve 25, prestressing the latter against the pressure booster bottom 16.

In the embodiment of the injector 1 according to FIG. 2, the stepped piston 18 is embodied in the form of a so-called "free-flying piston," which has no stroke stop on the control rod 10. As in FIGS. 3 and 4, the control rod spring 24 here clamps and seals the control rod 10 against the end plate 34. The advantage here is that rapid pressure changes are compensated for directly by means of stroke changes of the stepped piston 18, thus making it possible to assure that the injector 1 does not open unintentionally, particularly in the event of a rapid decrease in system pressure.

The depiction in FIG. 3 shows a variant in which the filling and resetting of the pressure booster 17 is assured not by an opening of the filling sleeve 25, but by a modified nozzle needle sleeve 14. In this case, a sealing edge of the nozzle needle sleeve 14 is situated radially toward the outside in comparison to the embodiments of the injector 1 according to FIGS. 1 and 2. A sealing diameter of the nozzle needle sleeve 14 therefore lies on a larger diameter, which achieves an opening when a pressure in the needle control chamber 22 is greater than in the nozzle chamber 28.

In the variant according to FIG. 4, a stepped piston resetting by means of the stepped piston spring 32 has also been redesigned to make it possible to achieve an advantage in terms of space. For this reason, the stepped piston spring 32 rests against the injector body 2 via an annular collar 38 and presses against the stepped piston 18 via a washer 39 in order to reset the stepped piston after the end of the injection process.

The function of the injector 1 according to the invention can be described as follows:

First, all of the volumes of the injector 1 are at the system pressure level. If the pressure in the coupling path 11 is reduced through actuation of the valve device 9, then the pressure in the needle control chamber 22 and the pressure in the coupler chamber 19 decrease. On one hand, this causes an increase in the forces acting in the opening direction on the nozzle needle 13, causing it to open. On the other hand, a pressure increase occurs in the pressure booster chamber 27 as a result of a pressure decrease in the coupler chamber 19. Consequently, the pressure in the nozzle chamber 28 also increases and the injector 1 injects fuel into a combustion chamber at an injection pressure that is higher than the system pressure.

In order to close the injector 1, the valve device 9 is actuated, in particular closed, causing the pressures in the needle control chamber 22 and in the coupler chamber 19 to rise to system pressure again. If the pressures have returned to the system pressure level, then the stepped piston spring 32 produces a slight negative pressure in the pressure booster chamber 27, causing the filling sleeve 25 to open and the resetting of the stepped piston 18 in combination with a volume compensation, causes a resetting of the injector 1 into its initial position.

One particular advantage of the injector 1 according to the invention is the central location of the coupling path 11 inside the control rod 10, which permits the elimination of high-pressure bores in the injector body 2. This makes it possible to achieve a high injection pressure with a simultaneously moderate system pressure by means of only a single valve device 9. At the same time, it is possible to achieve a rapid switching of the nozzle needle 13 and a significantly improved multiple injection capacity due to a large volume of the high-pressure chamber 8 and reduced pressure pulsations through the elimination of control lines.

The foregoing relates to the preferred exemplary embodiments of the invention, it being understood that other variants and embodiments thereof are possible within the spirit and scope of the invention, the latter being defined by the appended claims.

The invention claimed is:

1. An injector for a fuel injection system of an internal combustion engine, the injector comprising:

an injector body that has a pressure booster section and a needle section, with at least one injection orifice provided in the needle section;

a nozzle needle that is situated to execute a stroke motion in the needle section in order to control an injection of fuel through the at least one injection orifice; and a pressure booster for increasing a fuel injection pressure in relation to a system pressure, the pressure booster having a stepped piston, a control rod, and a pressure booster bottom, which cooperate with one another to delimit a coupler chamber, wherein a coupling path extends in the control rod and connects the coupler chamber to a high-pressure fuel supply via a valve device situated outside or inside the injector, wherein the pressure booster bottom is separate from the stepped piston and the stepped piston is movable relative to the pressure booster bottom, and wherein the piston defines an interior space, the pressure booster bottom extends upward into the space, and the control rod extends downward into the space.

2. The injector as recited in claim 1, wherein the end of the control rod oriented toward the nozzle needle reaches into a cavity provided in the pressure booster bottom, and the cavity is hydraulically connected via a connecting path to a needle control chamber that is delimited by the nozzle needle, a nozzle needle sleeve encompassing the needle, and the pressure booster bottom.

3. The injector as recited in claim 2, wherein the cavity is connected to the coupler chamber via the coupling path.

4. An injector for a fuel injection system of an internal combustion engine, the injector comprising:

an injector body that has a pressure booster section and a needle section, with at least one injection orifice provided in the needle section;

a nozzle needle that is situated to execute a stroke motion in the needle section in order to control an injection of fuel through the at least one injection orifice; and a pressure booster for increasing a fuel injection pressure in relation to a system pressure, the pressure booster having a stepped piston, a control rod, and a pressure booster bottom, which cooperate with one another to delimit a coupler chamber, wherein a coupling path extends in the control rod and connects the coupler chamber to a high-pressure fuel supply via a valve device situated outside or inside the injector, the end of the control rod oriented toward the nozzle needle reaches into a cavity provided in the pressure booster bottom, the cavity is hydraulically connected via a connecting path to a needle control chamber that is delimited by the nozzle needle, a nozzle needle sleeve encompassing the needle, and the pressure booster bottom, and wherein a control rod spring is provided in the cavity and prestresses the control rod in the direction oriented out from the cavity.

5. The injector as recited in claim 3, wherein a control rod spring is provided in the cavity and prestresses the control rod in the direction oriented out from the cavity.

6. An injector for a fuel injection system of an internal combustion engine, the injector comprising:

an injector body that has a pressure booster section and a needle section, with at least one injection orifice provided in the needle section;

a nozzle needle that is situated to execute a stroke motion in the needle section in order to control an injection of fuel through the at least one injection orifice; and a pressure booster for increasing a fuel injection pressure in relation to a system pressure, the pressure booster having a stepped piston, a control rod, and a pressure booster bottom, which cooperate with one another to delimit a coupler chamber, wherein a coupling path extends in the control rod and connects the coupler chamber to a high-pressure fuel supply via a valve device situated outside or inside the injector, the end of the control rod oriented toward the nozzle needle reaches into a cavity provided in the pressure booster bottom, the cavity is hydraulically connected via a connecting path to a needle control chamber that is delimited by the nozzle needle, a nozzle needle sleeve encompassing the needle, and the pressure booster bottom, and wherein a closing compression spring is provided, one end of which rests against the nozzle needle sleeve and the other end of which rests against the nozzle needle, prestressing the nozzle needle sleeve against the pressure booster bottom and prestressing the nozzle needle into its closed position.

7. The injector as recited in claim 3, wherein a closing compression spring is provided, one end of which rests against the nozzle needle sleeve and the other end of which rests against the nozzle needle, prestressing the nozzle needle sleeve against the pressure booster bottom and prestressing the nozzle needle into its closed position.

8. The injector as recited in claim 4, wherein a closing compression spring is provided, one end of which rests against the nozzle needle sleeve and the other end of which rests against the nozzle needle, prestressing the nozzle needle sleeve against the pressure booster bottom and prestressing the nozzle needle into its closed position.

9. The injector as recited in claim 1, wherein the stepped piston is encompassed by a filling sleeve that is able to execute a stroke motion on it or by a stationary annular wall, and the stepped piston, the pressure booster bottom, and the filling sleeve or stationary annular wall delimit a pressure booster chamber.

10. The injector as recited in claim 8, wherein the stepped piston is encompassed by a filling sleeve that is able to execute a stroke motion on it or by a stationary annular wall, and the stepped piston, the pressure booster bottom, and the filling sleeve or stationary annular wall delimit a pressure booster chamber.

11. The injector as recited in claim 9, wherein the nozzle needle is situated to execute a stroke motion in a nozzle chamber, and the nozzle chamber is hydraulically connected to the pressure booster chamber via at least one through opening provided in the pressure booster bottom.

12. The injector as recited in claim 10, wherein the nozzle needle is situated to execute a stroke motion in a nozzle chamber, and the nozzle chamber is hydraulically connected to the pressure booster chamber via at least one through opening provided in the pressure booster bottom.

13. The injector as recited in claim 6, wherein a connecting line is provided in the pressure booster bottom, connecting the pressure booster chamber to the needle control chamber, and a throttle device is provided in the connecting line between the pressure booster chamber and the needle control chamber and/or in the connecting path between the cavity and the needle control chamber.

14. The injector as recited in claim 9, wherein a connecting line is provided in the pressure booster bottom, connecting the pressure booster chamber to the needle control chamber, and a throttle device is provided in the connecting line between the pressure booster chamber and the needle control chamber and/or in the connecting path between the cavity and the needle control chamber.

15. The injector as recited in claim 9, wherein a stepped piston spring is provided, one end of which rests against a stop on the injector body and the other end of which rests against the stepped piston, a prestressing spring is provided, one end of which rests against the stop and the other end of which rests against the filling sleeve, prestressing the latter against the pressure booster bottom or a prestressing spring is provided, one end of which rests against the stepped piston and the other end of which rests against the filling sleeve, prestressing the latter against the pressure booster bottom.

16. The injector as recited in claim 11, wherein a stepped piston spring is provided, one end of which rests against a stop on the injector body and the other end of which rests against the stepped piston, a prestressing spring is provided, one end of which rests against the stop and the other end of which rests against the filling sleeve, prestressing the latter against the pressure booster bottom or a prestressing spring is provided, one end of which rests against the stepped piston and the other end of which rests against the filling sleeve, prestressing the latter against the pressure booster bottom.

17. The injector as recited in claim 13, wherein a stepped piston spring is provided, one end of which rests against a stop on the injector body and the other end of which rests against the stepped piston, a prestressing spring is provided, one end of which rests against the stop and the other end of which rests against the filling sleeve, prestressing the latter against the pressure booster bottom or a prestressing spring is provided, one end of which rests against the stepped piston and the other end of which rests against the filling sleeve, prestressing the latter against the pressure booster bottom.

18. The injector as recited in claim 11, wherein the control rod has an annular external step, which is embodied in the form of a stop for the stepped piston and/or the injector body contains a high-pressure chamber in which the control rod, the stepped piston, and the filling sleeve or annular wall are situated.

19. The injector as recited in claim 13, wherein the control rod has an annular external step, which is embodied in the form of a stop for the stepped piston and/or the injector body contains a high-pressure chamber in which the control rod, the stepped piston, and the filling sleeve or annular wall are situated.

20. The injector as recited in claim 15, wherein the high-pressure fuel supply is directly connected to the high-pressure chamber via a hydraulic line and is indirectly connected to the coupling path in the control rod via the valve device.

21. The injector as recited in claim 1, wherein an end of the control rod extends into a cavity in the pressure booster bottom.

22. The injector as recited in claim 1, wherein the piston telescopes over the pressure booster bottom.

23. The injector as recited in claim 1, wherein the coupler chamber is part of the interior space outside of the control rod and above the pressure booster bottom.

* * * * *

UNITED STATES PATENT AND TRADEMARK OFFICE

CERTIFICATE OF CORRECTION

PATENT NO. : 8,418,941 B2
APPLICATION NO. : 12/600771
DATED : April 16, 2013
INVENTOR(S) : Melzer et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 768 days.

Signed and Sealed this
First Day of September, 2015

Michelle K. Lee

Michelle K. Lee
*Director of the United States Patent and Trademark Office*